US006415537B1

(12) United States Patent
Kenney

(10) Patent No.: US 6,415,537 B1
(45) Date of Patent: Jul. 9, 2002

(54) PRINT HOLDER

(76) Inventor: Richard E. H. Kenney, 224 Earl Stewart Dr., Aurora, Ontario (CA), L4G 6S5

( * ) Notice: Subject to any disclaimer, the term of this patent is extended or adjusted under 35 U.S.C. 154(b) by 0 days.

(21) Appl. No.: 08/203,300

(22) Filed: Mar. 1, 1994

Related U.S. Application Data

(63) Continuation-in-part of application No. 08/031,720, filed on Mar. 15, 1993, now abandoned.

(51) Int. Cl.[7] ..... A47G 1/06

(52) U.S. Cl. ..... 40/661; 40/737; 40/765; 40/649

(58) Field of Search ..... 40/661, 649, 152, 40/152.1, 611, 156, 159, 765, 771, 737, 775, 642.02

(56) References Cited

U.S. PATENT DOCUMENTS

| | | | | | |
|---|---|---|---|---|---|
| 568,168 | A | * | 9/1896 | Pougher | 40/737 |
| 2,297,285 | A | * | 9/1942 | Bledsoe | 40/661 |
| 2,409,814 | A | | 10/1946 | Vargish | |
| 2,434,860 | A | | 1/1948 | Oxley | |
| 3,452,463 | A | | 7/1969 | Chaput | |
| 3,836,419 | A | * | 9/1974 | Hamberger | 40/152.11 X |
| 3,956,837 | A | | 5/1976 | Itano | |
| D249,766 | S | | 10/1978 | Munn | |
| 4,215,497 | A | * | 8/1980 | Levy | 40/661 |
| 4,229,892 | A | * | 10/1980 | Hueter et al. | 40/152.1 |
| 4,271,618 | A | * | 6/1981 | Lyman | 40/661 |
| 4,384,416 | A | * | 5/1983 | Kanzelberger | 40/661 |
| 4,442,617 | A | | 4/1984 | Frye et al. | |
| 4,496,127 | A | * | 1/1985 | Nelson | 40/661 |
| 4,594,802 | A | | 6/1986 | Field | |
| 5,222,315 | A | | 6/1993 | Lovison | |
| D352,176 | S | | 11/1994 | McMillan | |

FOREIGN PATENT DOCUMENTS

| | | |
|---|---|---|
| DE | G87 17 449.9 | 4/1989 |

OTHER PUBLICATIONS

Burnes of Boston—1983, #8181 Frame left rear, copy in des library.

* cited by examiner

*Primary Examiner*—Cassandra H. Davis
(74) *Attorney, Agent, or Firm*—Dinesh Agarwal, P.C.

(57) ABSTRACT

A plastic T card holder formed from molded plastic pieces permanently united face to face and defining between them a pocket which will snugly receive a thin rectangular card. The pocket has a long upper opening through which a card may be introduced and a narrow lower opening through which a knife blade, a stiff card or the like can be inserted to dislodge the card upwardly. The card holder has considerable advantages of economy of manufacture and provides improved protection of the card and is resistant to breakage as compared with the conventional card holders.

7 Claims, 4 Drawing Sheets

PRINT HOLDER

This application is a continuation-in-part of application Ser. No. 08/031,720 filed Mar. 15, 1993 now abandoned.

Print holders are widely used for display of cards or like printed sheet informational material to the general public, for example on service counters and tables in eating and drinking establishments and in hotels, business offices, stores, banks, and in homes for the display of photographic prints, artwork, and the like.

Conventionally, print holders are of one piece construction, usually of T-form, and comprise a transparent plastic plate that is heat softened and bent to form two opposed major portions connected at an upper end through a sharply curved bend, and a base bent outwardly on one or both sides. The bending is performed in such manner that the two major portions are biased resiliently into contact with one another, so that when a card is inserted for display in the print holder it is gripped and retained resiliently between these portions.

The manufacture of these conventional print holders is a time-consuming and relatively skilled operation which is usually performed largely by hand and therefore the manufacture of the items is relatively slow and expensive.

In addition, the sharp bend at the upper end tends to concentrate stress and the holders are vulnerable to breakage along this bend when portions thereof are gripped and pulled laterally outwardly. This breakage is quite common and may occur as a result of deliberate vandalism or accidentally, for example when replacing a card. Moreover, the engagement of the card is often not as positive as is desirable and the card may become partly displaced or may fall out of the holder so that the card rapidly tends to become bent, stained or soiled and requires undesirably frequent replacement.

The present invention provides a print holder comprising first and second molded transparent plastic pieces of which at least one is of generally L-shape and leach comprising a generally planar upright portion, said at least one piece having a base portion extending rearwardly from a lower edge thereof, said planar upright portions being permanently united together at least along portions extending along each side edge of said print holder, a central portion of at least one of said pieces being recessed inwardly to define with the other piece a pocket having an upper opening at an upper end of the print holder, and a lower opening formed adjacent said lower edges of length less than the length of said upper opening whereby a print or like sheet member of width greater than the length of said lower opening and less than the length of the upper opening can be inserted and retained in said pocket and may be dislodged upwardly through said upper opening by applying a thin bladed tool through said lower opening.

The pieces from which the present print holder is made can be molded accurately at high speed using conventional molding techniques, for example by injection molding and the pieces are adapted to be accurately united together at high rates of production either semi-manually or using automated assembly machines, and hence the manufacture of the print holder can be conducted efficiently and relatively inexpensively. The resulting holder is resistant to breakage at least as a result of normal hand-applied forces.

The print holder pocket can be manufactured to have accurate dimensions of width, length and depth so as to snugly receive a card or like sheet material of standard dimensions and thickness and the sheet is not liable to be dislodged or to fall out of the holder except by application of a knife blade, stiff card, or like thin bladed tool to dislodge the sheet from the pocket. Hence the sheet displayed in the holder is retained securely and is protected from damage, staining or soiling.

The accompanying drawings illustrate by way of example preferred forms of print holder in accordance with the invention.

Figure 1:
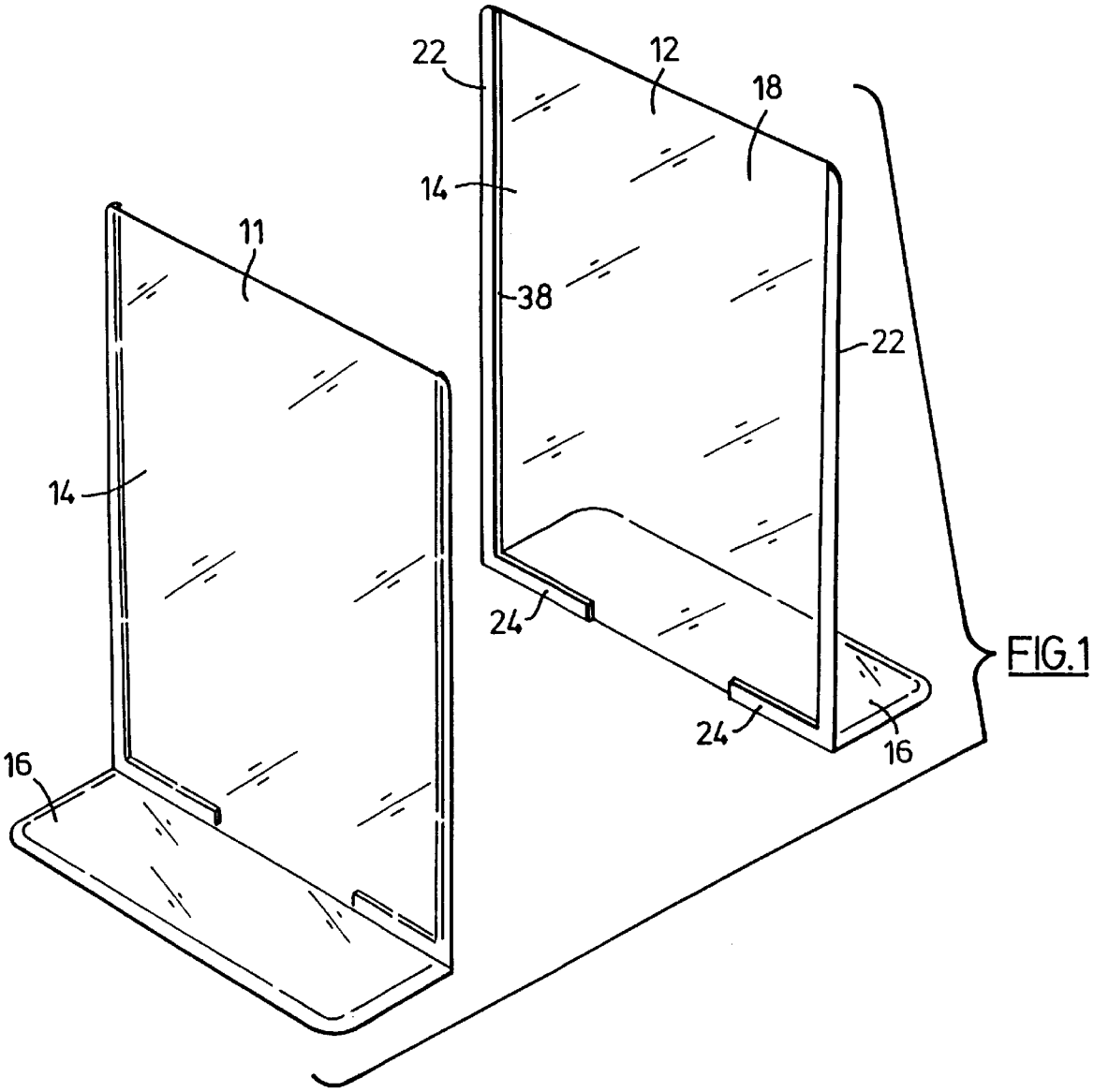
FIG. 1 is a perspective view showing two molded halves of a T-card holder in accordance with the invention ready for uniting together.
Figure 3:
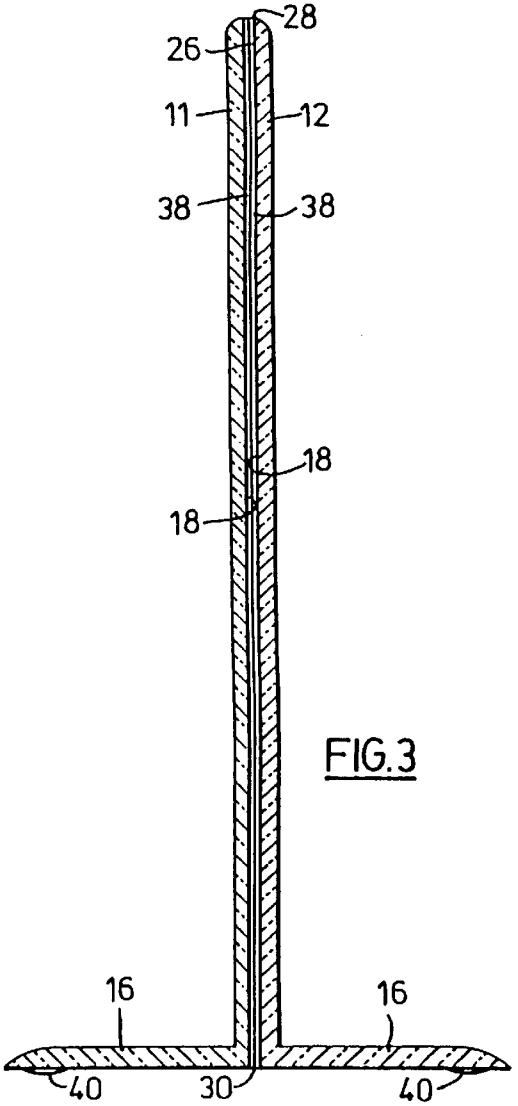
FIG. 3 is a vertical cross-section through a longitudinal median of the completed print holder of FIG. 1.
Figure 2:
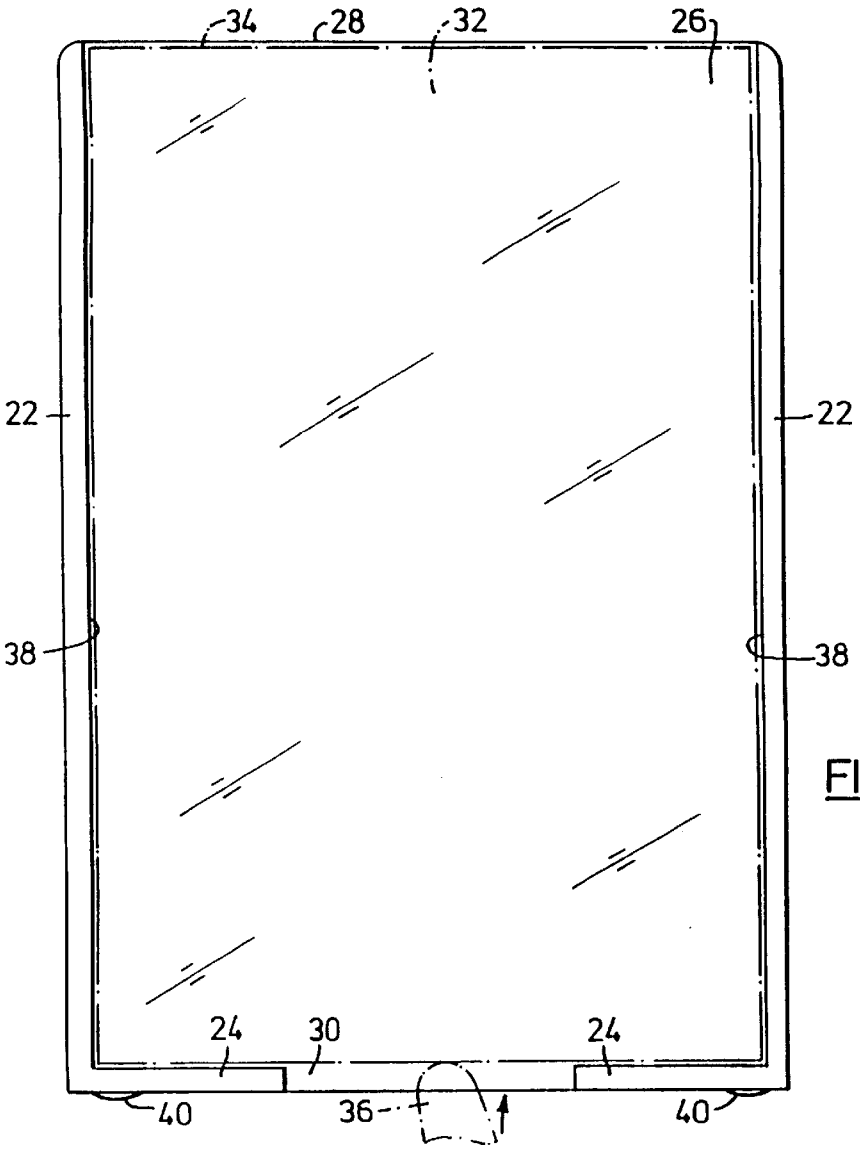
FIG. 2 is a side view of one half of the holder of FIG. 1, with an inserted sheet and a thin bladed tool shown in chain dotted lines.

Referring to the drawings, wherein like reference numerals indicate like parts, the preferred form of print holder shown in the drawings comprises first and second molded transparent plastic pieces 11 and 12. In FIGS. 1 to 3, each piece is of generally L-shape with a generally planar upright portion 14 and a base portion 16 extending rearwardly from a lower edge of the portion 14.

The pieces 11 and 12 as shown are similar or identical and are adapted to be molded by conventional plastics molding techniques, such as injection molding, in a common die cavity. More usually, a plurality, for example four or more, of the pieces 11 and 12 are molded simultaneously using a die having a plurality of identical die cavities.

The outer face of each piece 11 and 12 has its edges and corners smoothly rounded.

The lower side of each base portion 16 is generally planar.

The inner face of each piece 11 and 12 is formed with a shallow recess 18 which is defined between raised edge portions 22 which, in the example shown, extended continuously along each side edge of the pieces 11 and 12 and merge at the lower end with a raised lower edge portion 24 which extends part way inwardly along the lower edge of the upright portion 14.

The outer side of each of the portions 22 and 24 is planar. To form the finished print holder the outer sides of the portions 22 and 24 of the two pieces 11 and 12 are united together, for example by gluing or by welding, so that the recesses 18 together define a pocket 26 having a relatively long upper opening 28 and a relatively short lower opening 30 defined between the ends of the juxtaposed lower edge portions 24.

As seen in FIG. 2, the pocket 26 may receive a card 32 or like sheet material of substantially the width of the upper opening 28 and which, in the display position, rests on the upper edges of the portions 24. Normally, the material 32 is retained quite positively within the pocket 26 and is not easily removed, assuming the depth of the pocket 26 is greater than the length of the card and the upper edge 34 of the card 32 is below the upper edge of the united pieces 11 and 12.

As indicated in FIG. 2, the print or other sheet material 32 may be removed by inserting a thin-bladed tool 36, such as a knife blade, or a corner of a stiff business card, upwardly through the opening 30 to engage the sheet 32 and dislodge it upwardly.

The width of the pocket 26, that is the distance between the two opposed recess surfaces 18, as seen in FIG. 3, is preferably quite small so that the pocket will snugly receive one or two thickness of standard card stock.

As will be appreciated, the edge portions 22 and 24 may be in the form of regularly spaced circular bosses or like discrete shallow projections which are united together face to face. Preferably, as shown, the edge portions 22 define a rectangular pocket 26 with parallel sides which are continuous or substantially continuous so that the pocket 26 resists movement of a card 32 or other sheet material of width substantially the length of the pocket out of the pocket 26 under the influence of gravity in the event the card holder is held upside down. The sides of the pocket 26 tend to interfere with the edges or corners of the card 32 or other sheet material unless this is aligned exactly parallel to and slightly spaced from each side of the pocket and hence tend to prevent the card 32 or other sheet material from falling out.

Preferably, the sides of the pocket 26, that is the side faces 38 of at least the vertically extending edge portions 22 are parallel to one another and are substantially at right angles to the recessed faces 18 forming the opposing main faces of the pocket 26 to assist in positively locating the card 32 or other sheet material.

Preferably, the lower side of each base portion 16 is formed with a pair of transversely spaced feet, for example in the form of small convexly curved projections 40 which space the lower face of each base portion 16 and the opening 30 above a counter or other support surface on which the card holder is placed.

Figure 4:
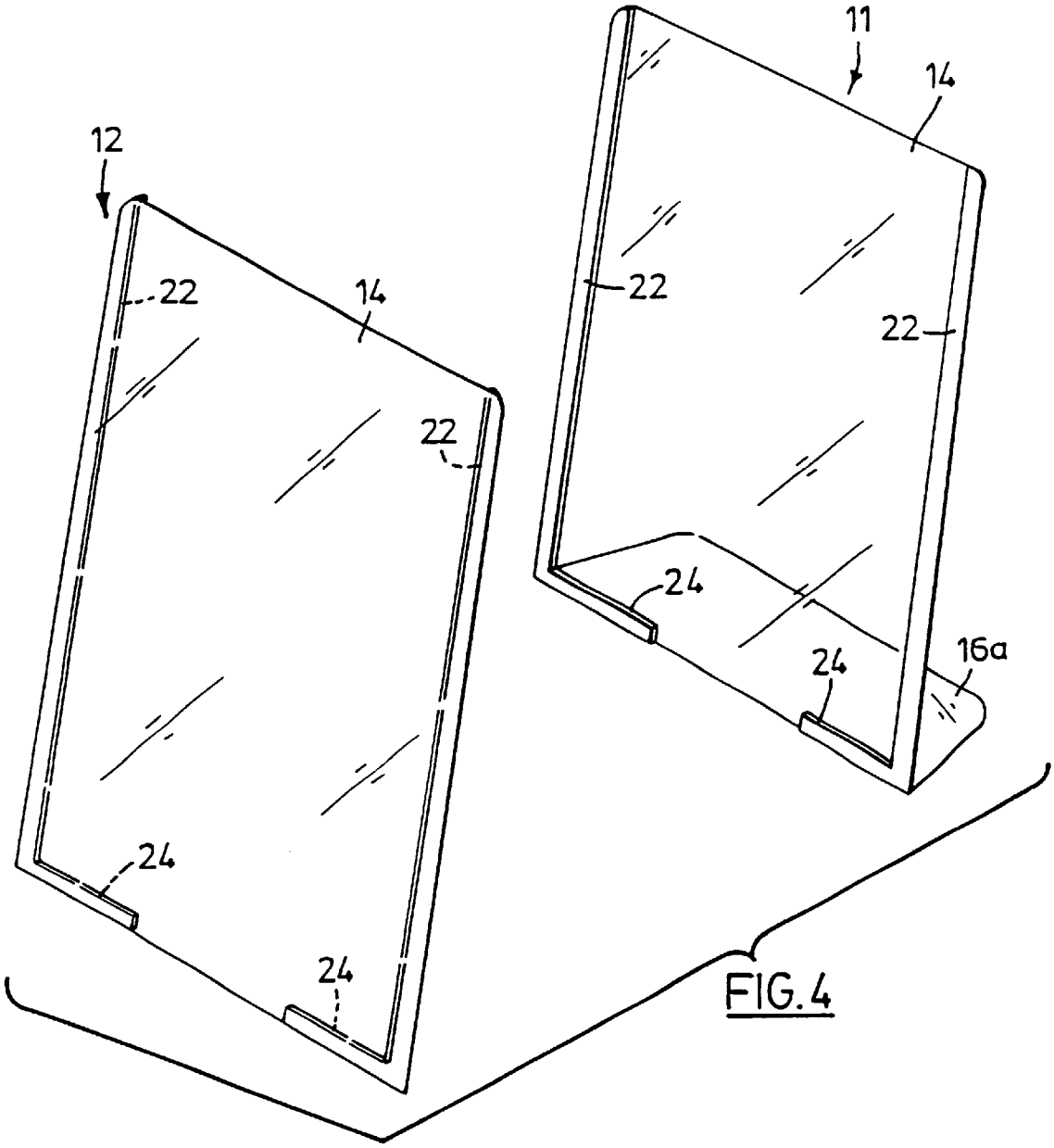
FIG. 4 is a perspective view similar to FIG. 1 showing the halves of an easel style print holder ready for uniting together.
Figure 5:
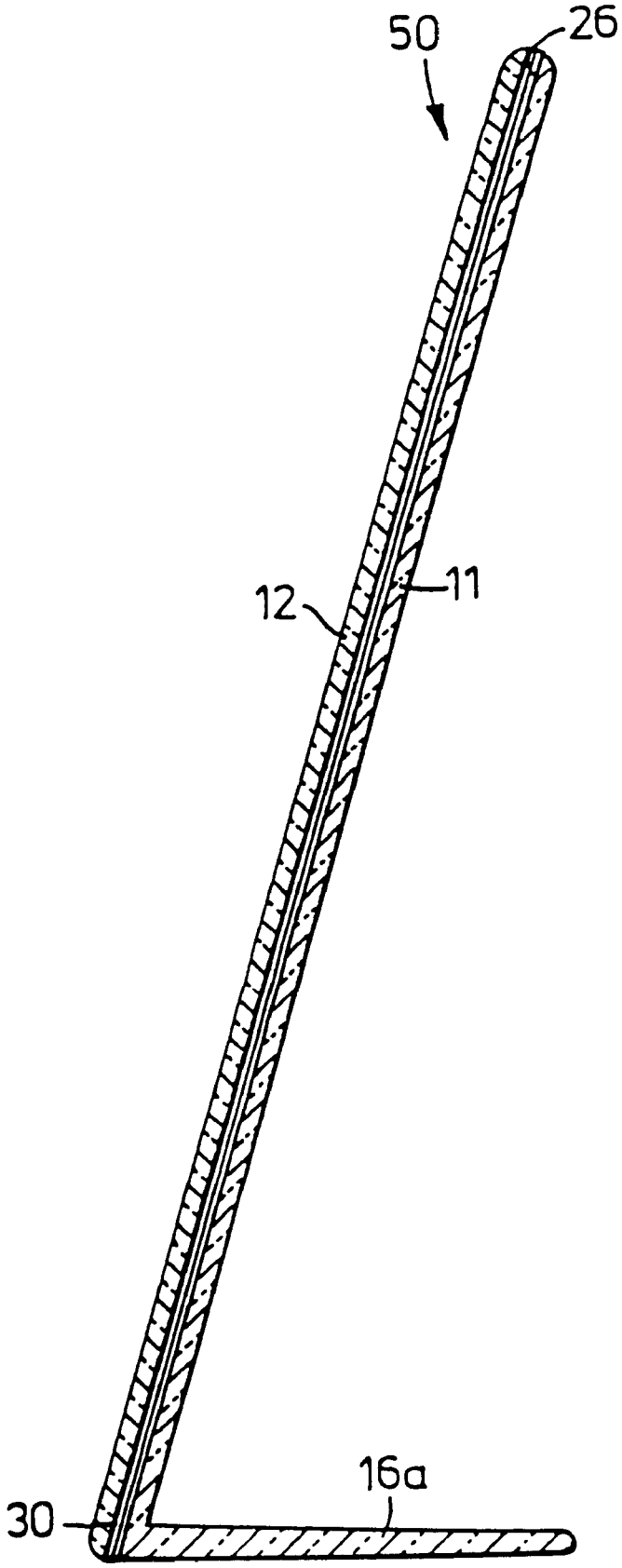
FIG. 5 is a vertical cross-section through a completed easel style print holder in accordance with FIG. 4.

In the modified or easel style version shown in FIGS. 4 and 5, only one plastic piece 11 is provided with a base portion 16*a* and, in the example. shown, the base 16*a* tapers rearwardly somewhat in width and thickness. The general plane of the portion 16*a* is inclined at an angle less than 90° to the general plane of the piece 11 so that the major portion of holder, comprising the planar portions 14 defining the opposing sides of the pocket 26, inclines upwardly rearwardly, in the direction toward the base portion 16*a*, when the base portion 16*a* is placed on a horizontal surface.

As in the embodiment of FIGS. 1 to 3, the pieces 11 and 12 shown in FIGS. 4 and 5 are permanently united together by welding or adhesively bonding together the faces of the edge portions 22 and 24 to provide between the pieces 11 and 12 a rectangular a rectangular recess or pocket 26 for reception and display of a print or the like inserted therein. As with the embodiment of FIGS. 1 to 3 the print may be removed by upward insertion of a blade or stiff card through the opening 30 to engage and dislodge the cover edge of the print.

In the preferred form, the pieces 11 and 12 are molded from highly transparent, thermoplastic material such as crystal polystyrene. Examples of other highly transparent plastics materials suitable for molding the items are well known to those skilled in the art and need not be described in detail here. For example, the optical properties of various molding plastics materials that may be used for the card holder of the invention are described in detail in Modern Plastics Encyclopedia 1984–1985, October 1984, Vol. 61, Number 10A, pages 591–593. Moreover, those skilled in the art are well aware of molding procedures for forming the pieces 11 and 12 and of methods of permanently uniting the pieces together. By "permanently uniting" is meant that the pieces cannot be separated except by destroying the structural integrity of the pieces. The pieces 11 and 12 can preferably be glued together with a cyanoacrylate adhesive, for example, or can be welded together using sonic welding. Examples of adhesives that may be used for adhesively bonding various plastics together and examples of procedures for thermal bonding and ultrasonic assembly of plastics pieces together, that may be used for uniting the pieces of the card holder of the invention permanently together are described in modern Plastics Encyclopedia 1985–1986, October 1985, Vol. 62, Number 10A, pages 350 to 352 and 362 to 366.

I claim:

1. A print holder comprising front and rear molded transparent plastic pieces of which at least said rear piece is of generally L-shape and each comprising a generally planar upright portion, said rear piece having a base portion extending rearwardly from a lower edge thereof, said planar upright portions having side edges and being permanently united together at least along portions extending along each side edge of said upright portions, said upright portions having generally the same length and width dimensions and including generally coterminous top edges, a central portion of at least one of said pieces having an inwardly recessed portion defining with other piece a generally continuous uninterrupted pocket having an upper opening at an upper end of the print holder and a lower opening formed adjacent said lower edges of length less than the length of said upper opening whereby a sheet member of width greater than the length of said lower opening and less than the length of the upper opening can be inserted and retained in said pocket and may be dislodged upwardly through said upper opening by applying a thin bladed tool through said lower opening.

2. A holder as claimed in claim 1 wherein said pocket has substantially continuous parallel sides.

3. A holder as claimed in claim 2 wherein said sides are substantially perpendicular to said recessed central portions.

4. A holder as claimed in claim 2 wherein said pocket is substantially rectangular.

5. A holder as claimed in claim 1 wherein said pieces are permanently united through adhesive bonding.

6. A holder as claimed in claim 1 wherein said pieces are permanently united through welding.

7. A holder as claimed in claim 6 wherein said welding is sonic welding.

* * * * *